US010411381B2

(12) United States Patent
Plested et al.

(10) Patent No.: US 10,411,381 B2
(45) Date of Patent: Sep. 10, 2019

(54) ELECTRICAL CONTACT

(71) Applicant: HARWIN PLC, Portsmouth, Hampshire (GB)

(72) Inventors: Mark Plested, Hampshire (GB); Damon De Laszlo, Hampshire (GB)

(73) Assignee: HARWIN PLC, Hampshire (GB)

( * ) Notice: Subject to any disclaimer, the term of this patent is extended or adjusted under 35 U.S.C. 154(b) by 0 days.

(21) Appl. No.: 15/708,511

(22) Filed: Sep. 19, 2017

(65) Prior Publication Data

US 2018/0083378 A1 Mar. 22, 2018

(30) Foreign Application Priority Data

Sep. 20, 2016 (GB) ..... 1616011.1

(51) Int. Cl.

| | |
|---|---|
| ***H01R 13/00*** | (2006.01) |
| ***H01R 24/20*** | (2011.01) |
| ***H01R 43/16*** | (2006.01) |
| ***H01R 13/40*** | (2006.01) |
| ***H01R 107/00*** | (2006.01) |
| ***H01R 13/11*** | (2006.01) |

(52) U.S. Cl.
CPC ..... *H01R 13/111* (2013.01); *H01R 13/40* (2013.01); *H01R 24/20* (2013.01); *H01R 43/16* (2013.01); *H01R 2107/00* (2013.01)

(58) Field of Classification Search
CPC ..... H01R 13/11; H01R 24/20; H01R 43/16
See application file for complete search history.

(56) References Cited

U.S. PATENT DOCUMENTS

| | | | | |
|---|---|---|---|---|
| 2,689,337 A | | 9/1954 | Burtt et al. | |
| 4,728,304 A | | 3/1988 | Fischer | 439/842 |
| 5,067,916 A | * | 11/1991 | Denlinger | H01R 43/16 29/885 |
| 5,376,012 A | | 12/1994 | Clark | 439/80 |
| 5,775,960 A | * | 7/1998 | Saito | H01R 13/187 439/843 |
| 5,938,487 A | | 8/1999 | Henry et al. | 439/857 |

(Continued)

FOREIGN PATENT DOCUMENTS

| | | | |
|---|---|---|---|
| EP | 0 261 778 | 8/1987 | H01R 13/115 |
| EP | 1 868 266 A1 | 12/2007 | H01R 13/11 |

(Continued)

OTHER PUBLICATIONS

UK Search Report dated Feb. 1, 2017 in related application GB1616011.1.

(Continued)

*Primary Examiner* — Briggitte R. Hammond
(74) *Attorney, Agent, or Firm* — Renner Kenner Greive Bobak Taylor & Weber

(57) ABSTRACT

The invention relates generally to a female electrical contact comprising a body portion and a contact portion that is distal to the body portion. The contact portion comprises a plurality of fingers tapered towards the longitudinal axis of the contact. The contact portion further comprises a tip portion at an end of the contact portion that is distal to the body portion, wherein the pluralities of fingers of the contact portion bend outward at the tip portion, away from the longitudinal axis of the contact.

14 Claims, 6 Drawing Sheets

(56) References Cited

U.S. PATENT DOCUMENTS

| | | | | |
|---|---|---|---|---|
| 7,497,742 | B2 * | 3/2009 | Spinnato | H01R 13/111 439/851 |
| 8,782,883 | B2 * | 7/2014 | Shimizu | H01R 13/111 29/874 |
| 8,821,196 | B2 | 9/2014 | Blasick et al. | 439/851 |
| 8,851,940 | B2 | 10/2014 | Friedhof et al. | 439/843 |
| 9,017,089 | B2 * | 4/2015 | Flower | H01R 4/00 29/874 |
| 9,325,095 | B2 * | 4/2016 | Glick | H01R 13/187 |
| 9,640,890 | B2 * | 5/2017 | Ito | H01R 13/111 |
| 2013/0225015 | A1 | 8/2013 | Blasick et al. | 439/842 |
| 2013/0337702 | A1 * | 12/2013 | Pavlovic | H01R 13/635 439/700 |

FOREIGN PATENT DOCUMENTS

| | | | | |
|---|---|---|---|---|
| GB | 2501063 | A | 10/2013 | H01R 43/16 |
| WO | WO 98/15036 | | 4/1998 | H01R 13/187 |
| WO | WO 2014/116338 | A1 | 7/2014 | |

OTHER PUBLICATIONS

European Search Report dated Feb. 16, 2018 in related application No. 17191788.3.

European Search Report dated Oct. 22, 2018 in related application No. 17191788.3.

* cited by examiner

ELECTRICAL CONTACT

FIELD OF INVENTION

The present invention relates to electrical contacts, in particular to high-reliability miniature electrical contacts.

BACKGROUND

An electrical connection can be made between two electrical devices, usually using a male and female electrical contact. One part of the connection has a male contact with an electrical pin and the other part is a female contact in the form of a socket for receiving the male contact.

Known female contacts include a female contact formed of a cylindrical base, the base having a stamped four finger clip inserted into one end. Examples of such known contacts are those of the Datamate and Micro D range that are manufactured by Harwin PLC. One problem with this type of contact is that, on a miniature scale, it is difficult to form the base and clip because these must be formed of very thin material that will not have the mechanical strength required to survive the insertion of the clip into the base. This problem is a significant barrier in the design and manufacture of complex miniature scale electrical contacts. In the present specification the term 'miniature' should be understood to mean length scales of the order of approximately a tenth of a millimeter up to a centimeter or so.

GB 2501063 A discloses a method of manufacturing a female electrical contact from a single piece of material by removal of material from the piece of material by machining, the removal of material comprising the steps of: forming at least one first hole in a first end of the material to form a contact portion, the at least one first hole formed along a longitudinal axis X of the material; making at least two slits in the contact portion to produce contact fingers, the slits extending from the first end along at least a portion of length of the contact portion. A corresponding single piece female contact is provided.

SUMMARY OF THE INVENTION

The present invention provides a female contact comprising a body portion and a contact portion that is distal to the body portion. The contact portion comprises a plurality of fingers tapered towards the longitudinal axis of the contact, and slots located between adjacent fingers. The tapering of the plurality of fingers of the contact portion may be uniform; however this is not a requirement. The contact portion further comprises a tip portion at an end that is distal to the body portion. At least one of the plurality of fingers of the contact portion bends outwards at the tip portion, away from the longitudinal axis of the contact. Some or all the fingers of the contact portion may bend outwards at their respective tip portions, away from the longitudinal axis of the contact. The tip portion in this invention acts to provide additional contact force for greater shock and vibration resistance.

In some cases, irrespective of the configuration of the contact, the female contact further comprises a protrusion located on the outer surface of the contact. Optionally, this protrusion can extend around the entire circumference of the contact. The contact can be configured such that the slots extend beyond the protrusion of the contact.

In some cases, irrespective of the configuration of the contact, a first hole is provided by the contact portion. Additionally, in some cases, at least one second hole is provided in the end of the piece of material that is distal to the contact portion. Optionally, the contact can include a through hole connecting the first and at least second holes to form a channel through the interior of the contact. A through hole can assist with the plating process and can allow the plating to completely cover the inside of the contact.

In some cases, irrespective of the configuration of the contact, at least a part of the contact can be plated. Optionally, the plating can include at least one of gold and nickel.

In some cases, irrespective of the configuration of the contact, a plurality of said contacts can be comprised within an insulating housing comprising a plurality of holes for the insertion of said plurality of contacts. In particular, from an aspect of the invention, an electrical connector is provided, comprising an insulating housing and at least one hole, wherein the aforementioned electrical contact is located within the at least one hole. In some cases, there may be a plurality of holes and one or more of the holes may be provided with the aforementioned contact.

BRIEF DESCRIPTION OF THE DRAWINGS

Embodiments of the present invention are now described, by way of example only, with reference to the accompanying drawings, in which.

DETAILED DESCRIPTION OF EMBODIMENTS

Figure 1:
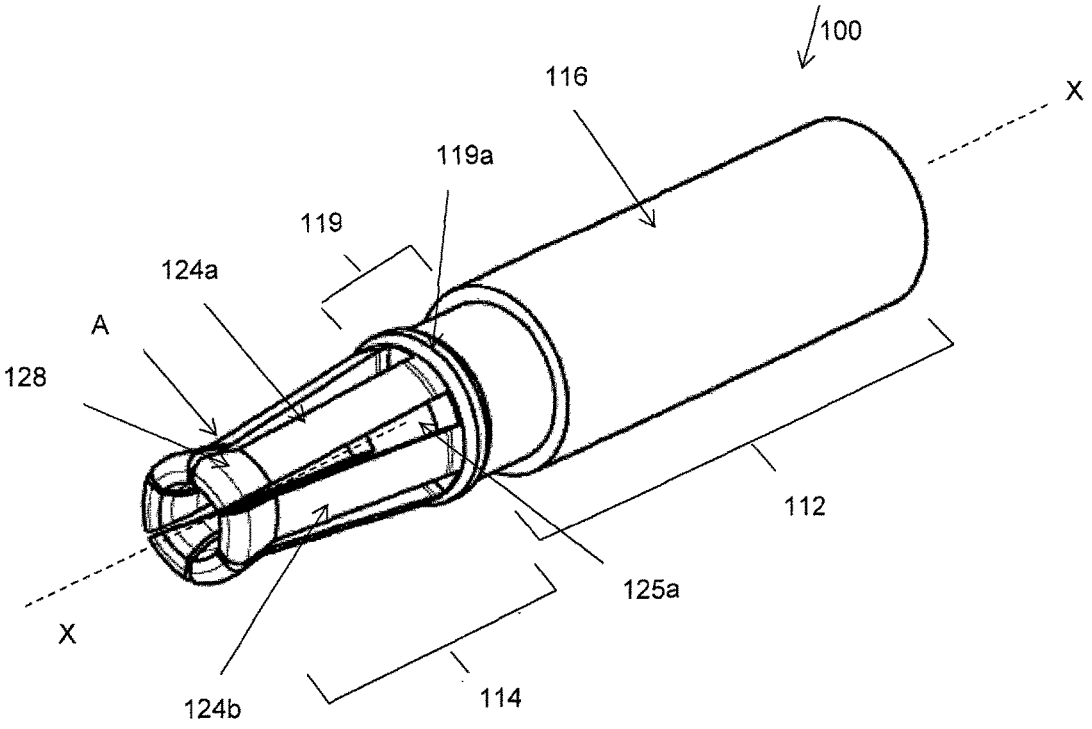
FIG. 1 shows a perspective view of a female contract in accordance with a first embodiment.

A miniature female contact 100 according to the first embodiment will now be described with reference to FIGS. 1, 2, 3 and 4. In the present embodiment contact 100 has an outer diameter of around 1.48 mm, but the present invention is not limited to this and it will be readily apparent to the skilled person that miniature contacts having other diameters may also be produced after consideration of the teaching herein. The typical exemplary dimensions are provided to outline the miniature extent of contacts that can provided by the present invention.

Contact 100 will be described herein in terms of a body portion 112 and a contact portion 114. Preferably contact 100 is formed of electrically conductive material such as beryllium copper, but other suitable materials known to the skilled person may be used.

Body portion 112 is substantially cylindrical and includes a barrel 116 that is centred on the longitudinal axis X of body portion 112. Barrel 116 is open at one end, this end being distal contact portion 114, to allow access to its interior. The interior surface of barrel 116 is contoured to form a receptacle. For ease of description the receptacle will be described in terms of two portions; a receptacle outer portion 118*a* and a receptacle inner portion 118*b*, although it should be understood that no gaps, breaks, interfaces or discontinuities are present between receptacle outer portion 118*a* and receptacle inner portion 118*b*.

Receptacle outer portion 118*a* is adjacent the open end of barrel 116 and receptacle inner portion 118*b* is adjacent receptacle outer portion 118*a* and is thus wholly contained within barrel 116. In the present embodiment the interior surface of barrel 116 is contoured such both receptacle outer portion 118*a* and receptacle inner portion 118*b* have a substantially cylindrical cross-section, with the diameter of receptacle outer portion 118*a* being larger than the diameter of receptacle inner portion 118*b*. In the present embodiment receptacle outer portion 118*a* is shorter in axial length than receptacle inner portion 118*b*.

The profile of the interior surface of barrel 116 allows a wire (not shown) to be received in the interior of barrel 116 via its open end. The wire is fed into receptacle outer portion 118*a* and receptacle inner portion 118*b*. Preferably a stripped (non-insulated) portion of the wire is positioned in receptacle inner portion 118*b* and a covered (insulated) portion of the wire is positioned in receptacle outer portion 118*a*. Arrangement of the wire in this manner advantageously allows the receptacle to act as a strain relief system for the wire.

Once the wire is in place, substantially uniform force is applied along and around the portion of the outer surface of barrel 116 that is aligned with receptacle inner portion 118*b*. This causes receptacle inner portion 118*b* to compress and in doing so secures the stripped portion of the wire in barrel 116 and ensures that a good electrical connection is made. This compression (or crimping) may be achieved using any tool known by the skilled person that is appropriate for the task, such as an 8 point indentation tool.

It should be understood that the interior profile of barrel 116 described above is purely exemplary and the interior of barrel 116 may define any other profile that is suitable for receiving a wire.

As mentioned earlier body portion 112 is substantially cylindrical. However a recessed portion 119 is located in the outer surface of body portion 112 at the end of body portion 112 that is proximate contact portion 114. Recessed portion 119 has a protrusion 119*a* along part of its length, with both recessed portion 119 and protrusion 119*a* being positioned to align with complimentary features in a housing (described later) in which contact 100 is secured. In the present embodiment protrusion 119*a* extends around the entire circumference of body portion 112.

In the interior of body portion 112 and adjacent receptacle inner portion 118*b* is a through hole 120. Adjacent through hole 120 is a drilled cavity 122. Both through hole 120 and drilled cavity 122 are centred on the longitudinal axis X of body portion 112. Like receptacles 118*a* and 118*b*, the extents of through hole 120 and drilled cavity 122 are defined by the contours of the inner surface of body portion 112 so as to form a channel 121 through the interior of the contact. In the present embodiment through hole 120 and drilled cavity 122 both have a substantially cylindrical shape, although other shapes may be used for either feature.

Through hole 120 has a diameter smaller than that of receptacle inner portion 118*b*, although other cross-sectional profiles and diameters may be used. The shape and dimensions of drilled cavity 122 are selected to allow a male pin (not shown) to fit snugly and securely within it. There are no gaps, breaks, interfaces or discontinuities in the portion of the interior surface of body portion 112 that defines receptacle inner portion 118*b* and through hole 120, and similarly no gaps, breaks, interfaces or discontinuities in the portion of the interior surface that defines through hole 120 and drilled cavity 122.

Through hole 120 and drilled cavity 122 allow access to the interior of body portion 112 (and consequently barrel 116) from the end of body portion 112 that is proximate contact portion 114. This is so that, in use, a male pin sits within contact portion 114, drilled cavity 122 and through hole 120 and is in electrical contact with the wire (not shown) via the stripped portion of the wire that is housed in receptacle inner portion 118*b*.

Through hole 120 is provided to allow at least some of and typically substantially all of the entire internal surface of body 112 to be plated, which improves the electrical contact between a male pin and contact 100 when in use. Known contacts use blind holes for this purpose which typically provide poor plating coverage at best. The provision of through hole 120 therefore improves the plating coverage of the interior surface of body 112 and consequently improves the reliability of contact 100. Preferably the plating comprises a nickel undercoat and a gold topcoat, but other platings known to the skilled person can be used.

Figure 2:
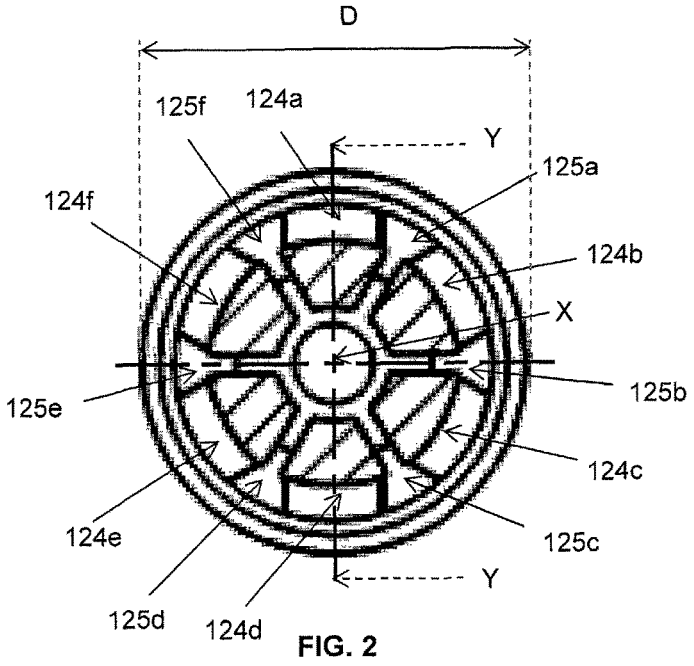
FIG. 2 shows a view from the contact finger end of the female contact of FIG. 1.
Figure 3:
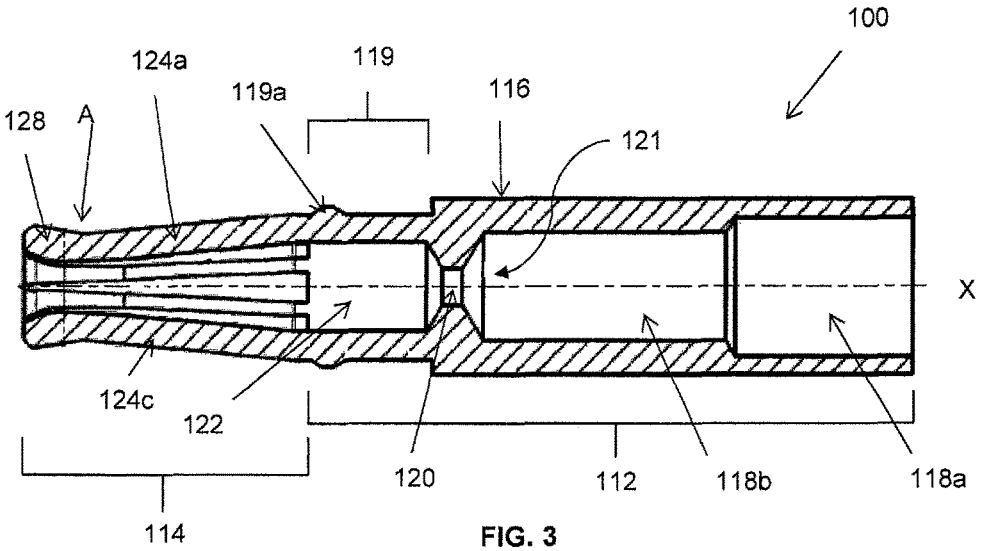
FIG. 3 shows a sectional view of the female contact of FIG. 1 along the longitudinal axis.
Figure 4:
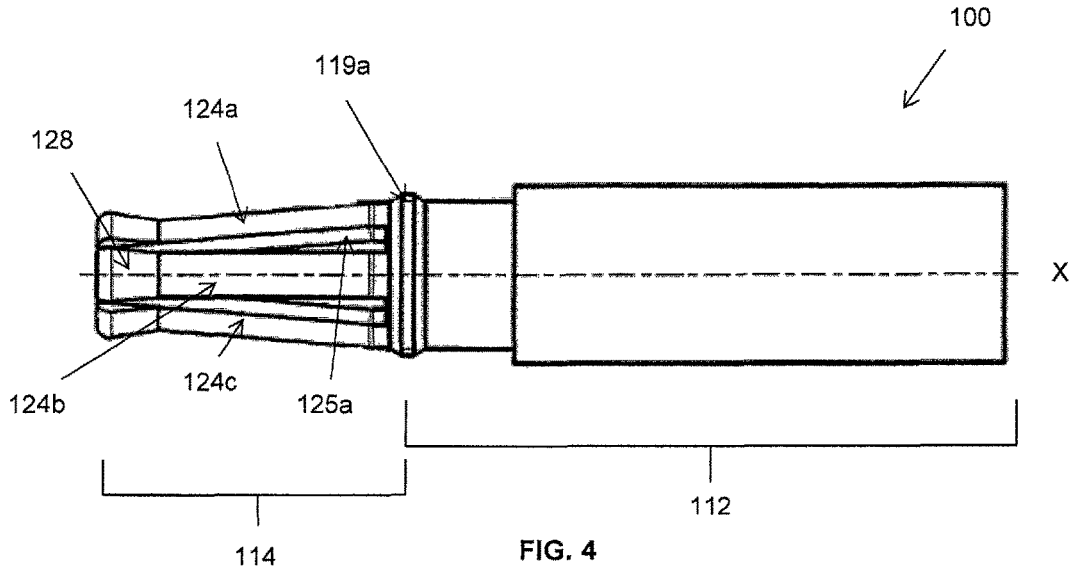
FIG. 4 shows a top view of the female contact of FIG. 1.
Figure 5:
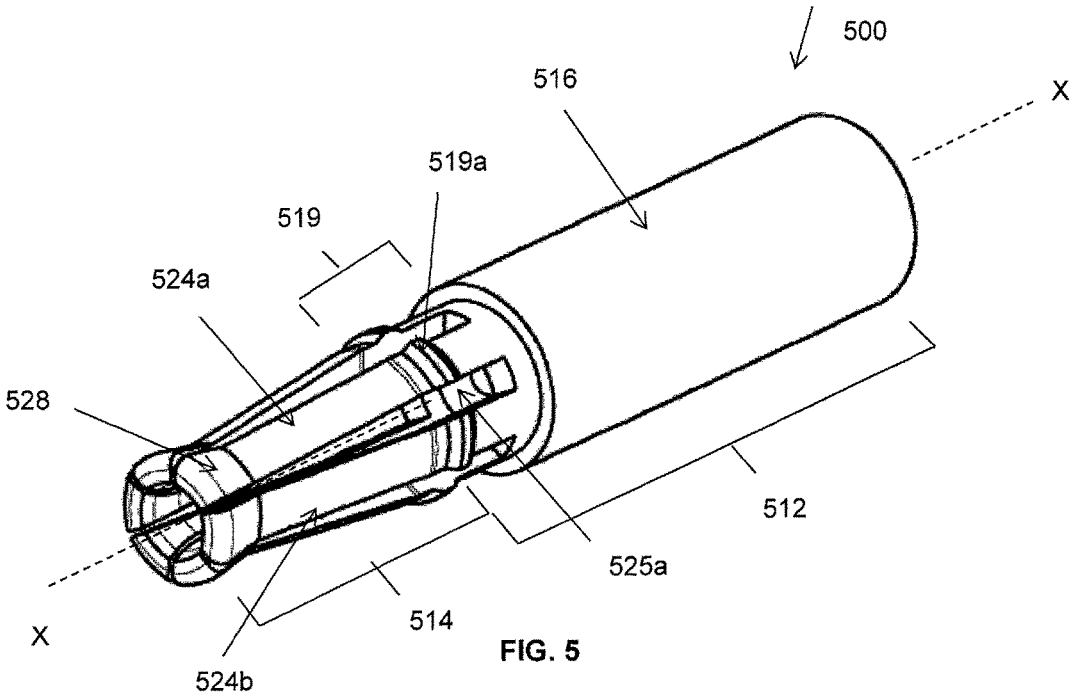
FIG. 5 shows a perspective view of a female contact in accordance with a second embodiment.
Figure 6:
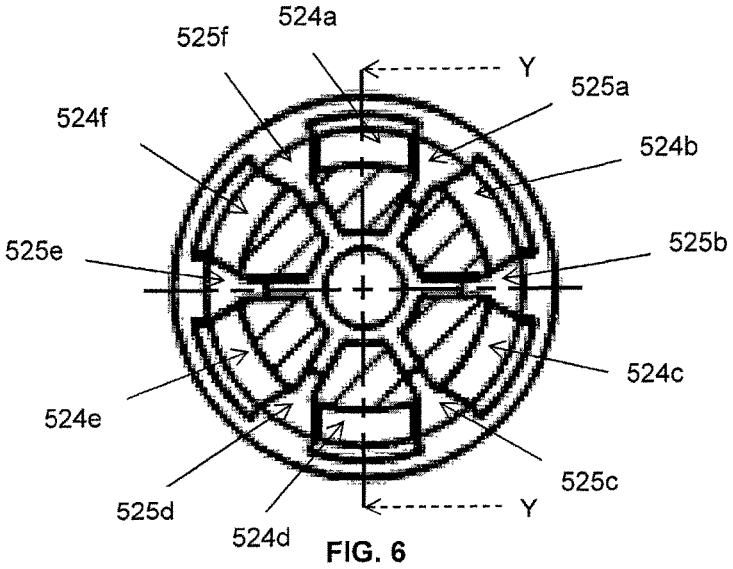
FIG. 6 shows a view from the contact finger end of the female contact of FIG. 5.

Turning now to contact portion 114, in the present embodiment this comprises six fingers 124*a*, 124*b*, 124*c*, 124*d*, 124*e* and 124*f* (only two of which are shown in FIG. 1; all six are shown in FIG. 2) and six slots 125*a*, 125*b*, 125*c*, 125*d*, 125*e* and 125*f* (only one of which is shown in FIG. 1) existing in the voids between adjacent fingers, but it will be appreciated that any other number of fingers can be present, hence any number of slots can also be present. Each of the fingers are identical to all of the others, such that only one finger 124*a* will be described in detail here. In the present embodiment the diameter of contact portion 114 at its widest point is 1.0 mm, but this is purely exemplary and a contact portion having any other diameter is also within the scope of the present invention. The design of contact portion 114, and in particular fingers 124*a*, 124*b* can act to provide additional contact force for high shock and vibration resistance when located within an electrical connector. One advantage of providing six fingers in an embodiment is that the six fingers increase the number of contacts points, compared to a contact with, for example, three or four fingers. The power, shock and vibration resistance is also improved with more fingers in this embodiment.

Finger 124*a* is formed of a sheet of material that extends away from the end of body portion 112 that contains drilled cavity 122. The finger 124*a* is formed into a sheet of material or any other shape through machining of a rod rather than being formed from a sheet that has been rolled for example. In the present embodiment finger 124*a* has the profile of a hollow frustum of a cone that has been cut into sixths along the length of its longitudinal axis X, where the longitudinal axis X of the frustum is aligned with the longitudinal axis X of body portion 112. Finger 124*a* is at an angle relative to the longitudinal axis of body portion 112, such that finger 124*a* converges towards this longitudinal axis X when moving from the base of finger 124*a* (the base of finger 124*a* being joined to body portion 112) towards the tip portion 128 of finger 124*a*.

The tip portion 128 is located at the end of finger 124*a* that is distal the body portion 112, and in the present embodiment, comprises a curved or angled portion that extends away from the longitudinal axis X of the body portion 112, creating a larger diameter at the end of the tip portion 128, relative to where the tip portion 128 begins on the contact portion 114. This characteristic results in a tip portion 128 with the profile of a hollow frustum of a cone that has been cut into sixths along the length of its longitudinal axis X, the tip portion 128 being located at the end of the contact portion 114, wherein one end of the tip portion having the smaller diameter meets the point where the diameter of the contact portion 114 is at its smallest. Tip portion 128 acts as a lead in or guide for a male pin (not shown) during mating, such that the male pin is more easily and readily inserted into contact portion 114. Furthermore, the outwardly flared tip portion 128 can be prevented from entering receptacle portions 118*a*, 118*b* of another similar contact and becoming interlocked when, for example, multiple contacts are being processing in high quantity during various manufacturing processes such as gold plating. It will therefore be apparent from the above that the contact portion 114 has fingers 124 that taper inwards towards the central longitudinal axis X and then taper outwards in the tip portion 128. The inner profile (surface) of the fingers mirrors the outer profile (outer surface) of the fingers such that they are substantially parallel. It will be appreciated that in an alternative embodiment, the inner profile may continue tapering inwards or substantially inwards toward the longitudinal axis whilst the outer profile tapers outwards resulting in an alternative tip portion (not shown). As is apparent from the above, the construction of in this embodiment can be achieved by manufacturing the fingers 124 from machined rod metal, as opposed to the commonly used sheet metal manufacturing process. This feature can allow the inside diameter of the contact portion 114 to have an independent profile or shape to that of the outside diameter across the length of the fingers 114. The non-parallel inside and outside surfaces of the fingers 124 allows the inside surface to have an optimum lead in for a mating pin, whilst allowing the outside diameter to increase at the tip portion 128. In either embodiment, only a relatively small part of one end of the contact portion forms the tip portion.

The increased diameter tip portion 128 (i.e. diameter D viewed from the contact portion end where the tip portion 128 is located) which has fingers diverging away from the longitudinal axis X can help prevent the contact portion 114 from entering into receptacle 118*b*. The end of the contact 100 where the tip portion 128 is located has a relatively large diameter compared to the diameter of the receptacle 118*b*. The tip portion 128 diverges away from the central longitudinal axis X after a location A where the contact portion has converged and, given the outer profile of the tip portion also diverges away, it is difficult or not possible for the contact to enter the receptacle 118*b*. This arrangement is useful when, for example, processing multiple contacts for plating or assembly where multiple contacts are collected in a container. Without this increased diameter tip portion, the contact portion may enter receptacles 118*a* and 118*b* which results in the undesirable locking together of contacts that can prevent correct plating of products and assembly problems. These problems can be addressed with the tip portion 128.

The tip portion 128 can also be used to retain various types of springs or '0' rings on the contact 100. These springs can be used to increase the contact force by variable amounts to improve both contact resistance and shock and vibration performance. In particular, location A of the contact portion with a reduced diameter (as explained above where one end of the tip portion 128 having the smaller diameter meets the point where the diameter of the contact portion 114 is at its smallest) can receive at least one spring and/or '0' ring (not shown) which can increase the force provided radially inwards at the reduced diameter area.

In use, a male pin (not shown) is inserted within the cavity defined by fingers 124*a*, 124*b* . . . and is held in position by these fingers.

FIG. 5-FIG. 8 illustrate a second embodiment which is similar to the electric contact of the first embodiment of FIG. 1, but wherein a plurality of slots 525*a-f* extend beyond a protrusion 519*a* and into a recessed portion 519 of the contact 500. This recessed portion 519 and protrusion 519*a* corresponds to the equivalent recessed portion 119 and protrusion 119*a* from the embodiment illustrated by FIG. 1. Consequently this increases the effective length of the plurality of fingers by extending the contact portion 514 into the recessed portion 519. Although the similarities and differences between the first and second embodiment will be apparent from the figures, for completeness, the contact 500 will now be described with reference to FIGS. 5 to 8.

Contact 500 will be described herein in terms of a body portion 512 and a contact portion 514. The body portion 512 is similar to the body portion of 112 of FIG. 1. Preferably contact 500 is formed of electrically conductive material such as beryllium copper, but other suitable materials known to the skilled person may be used.

Body portion 512 is substantially cylindrical and includes a barrel 516 that is centred on the longitudinal axis X of body portion 512. Barrel 516 is open at one end, this end being distal contact portion 514, to allow access to its interior. The interior surface of barrel 516 is contoured to form a receptacle. For ease of description the receptacle will be described in terms of two portions; a receptacle outer portion 518*a* and a receptacle inner portion 518*b*, although it should be understood that no gaps, breaks, interfaces or discontinuities are present between receptacle outer portion 518*a* and receptacle inner portion 518*b*.

Receptacle outer portion 518*a* is adjacent the open end of barrel 516 and receptacle inner portion 518*b* is adjacent receptacle outer portion 518*a* and is thus wholly contained within barrel 516. In the present embodiment the interior surface of barrel 516 is contoured such both receptacle outer portion 518*a* and receptacle inner portion 518*b* have a substantially cylindrical cross-section, with the diameter of receptacle outer portion 518*a* being larger than the diameter of receptacle inner portion 518*b*. In the present embodiment receptacle outer portion 518*a* is shorter in axial length than receptacle inner portion 518*b*.

The profile of the interior surface of barrel 516 allows a wire (not shown) to be received in the interior of barrel 516 via its open end. The wire is fed into receptacle outer portion 518*a* and receptacle inner portion 518*b*. Preferably a stripped (non-insulated) portion of the wire is positioned in receptacle inner portion 518*b* and a covered (insulated) portion of the wire is positioned in receptacle outer portion 518*a*. Arrangement of the wire in this manner advantageously allows the receptacle to act as a strain relief system for the wire.

Once the wire is in place, substantially uniform force is applied along and around the portion of the outer surface of barrel 516 that is aligned with receptacle inner portion 518*b*. This causes receptacle inner portion 518*b* to compress and in doing so secures the stripped portion of the wire in barrel 516 and ensures that a good electrical connection is made. This compression (or crimping) may be achieved using any tool known by the skilled person that is appropriate for the task, such as an 8 point indentation tool.

It should be understood that the interior profile of barrel 516 described above is purely exemplary and the interior of barrel 516 may define any other profile that is suitable for receiving a wire.

As mentioned earlier, body portion 512 is substantially cylindrical. However the recessed portion 519 is located in the outer surface of body portion 512 at the end of body portion 512 that is proximate contact portion 514. Recessed portion 519 has a protrusion 519*a* along part of its length, with both recessed portion 519 and protrusion 519*a* being positioned to align with complimentary features in a housing (described later) in which contact 500 is secured. In the present embodiment protrusion 519*a* extends around the circumference of body portion 512 with the plurality of slots 525*a-f* forming multiple spaces in the protrusion 519*a*.

In the interior of body portion 512 and adjacent receptacle inner portion 518*b* is a through hole 520. Adjacent through hole 520 is a drilled cavity 522. Both through hole 520 and drilled cavity 522 are centred on the longitudinal axis X of body portion 512. Like receptacles 518*a* and 518*b*, the extents of through hole 520 and drilled cavity 522 are defined by the contours of the inner surface of body portion 512 so as to form a channel 521 through the interior of the contact. In the present embodiment through hole 520 and drilled cavity 522 both have a substantially cylindrical shape, although other shapes may be used for either feature.

Similarly to the equivalent features (120, 118*b*) of FIG. 1, through hole 520 has a diameter smaller than that of receptacle inner portion 518*b*, although other cross-sectional profiles and diameters may be used. The shape and dimensions of drilled cavity 522 are selected to allow a male pin (not shown) to fit snugly and securely within it. There are no gaps, breaks, interfaces or discontinuities in the portion of the interior surface of body portion 512 that defines receptacle inner portion 518*b* and through hole 520.

Through hole 520 and drilled cavity 522 allow access to the interior of body portion 512 (and consequently barrel 516) from the end of body portion 512 that is proximate contact portion 514. This is so that, in use, a male pin sits within contact portion 514, drilled cavity 522 and through hole 520 and is in electrical contact with the wire (not shown) via the stripped portion of the wire that is housed in receptacle inner portion 518*b*.

Through hole 520 is provided to allow at least some of and typically substantially all of the entire internal surface of body 512 to be plated, which improves the electrical contact between a male pin and contact 500 when in use. Known contacts use blind holes for this purpose which typically provide poor plating coverage at best. The provision of through hole 520 therefore improves the plating coverage of the interior surface of body 512 and consequently improves the reliability of contact 500. Preferably the plating comprises a nickel undercoat and a gold topcoat, but other platings known to the skilled person can be used.

Turning now to contact portion 514, in the present embodiment this comprises six fingers 524*a*, 524*b*, 524*c*, 524*d*, 524*e* and 524*f* (only two of which are shown in FIG. 1; all six are shown in FIG. 2) and six slots 525*a*, 525*b*, 525*c*, 525*d*, 525*e* and 525*f* existing between adjacent fingers, but it will be appreciated that any other number of fingers can be present, hence any number of slots can also be present. Each of the fingers are identical to all of the others, such that only one finger 524*a* will be described in detail here. In the present embodiment the diameter of contact portion 514 at its widest point is 1.0 mm, but this is purely exemplary and a contact portion having any other diameter is also within the scope of the present invention. The design of contact portion 514, and in particular fingers 524*a*, 524*b* can act to provide additional contact force for high shock and vibration resistance when located within an electrical connector.

As mentioned above, differently to the first embodiment, fingers 524*a*, 524*b*, 524*c*, 524*d*, 524*e* and 524*f* extend beyond the protrusion 519*a* and into the recessed portion 519 of the contact 500. This provides advantages relating to compliance of the contact.

Finger 524*a* is formed of a sheet of material that extends away from near one end of recessed portion 519 that contains drilled cavity 522 and adjacent the barrel 516. The finger 524*a* is formed into a sheet of material or any other shape through machining of a rod rather than being formed from a sheet that has been rolled for example. In the present embodiment finger 524*a* has the profile of a linear portion 519*b* (see FIG. 8) with a wall at one end that is generally parallel to the longitudinal axis X of the contact 500 and adjacent to the linear portion 519*b*, an angled portion that is a hollow frustum of a cone that has been cut into sixths along the length of its longitudinal axis X, where the longitudinal axis X of the frustum is aligned with the longitudinal axis X of body portion 512. Finger 524*a* is at an angle in the angled portion relative to the longitudinal axis of body portion 512, such that finger 524*a* converges towards this longitudinal axis X when moving from the part of the finger 524*a* at the protrusion 519*a* (the part of the finger 524*a* being joined to body portion 512) towards tip portion 528 of finger 524*a*.

Figure 7:
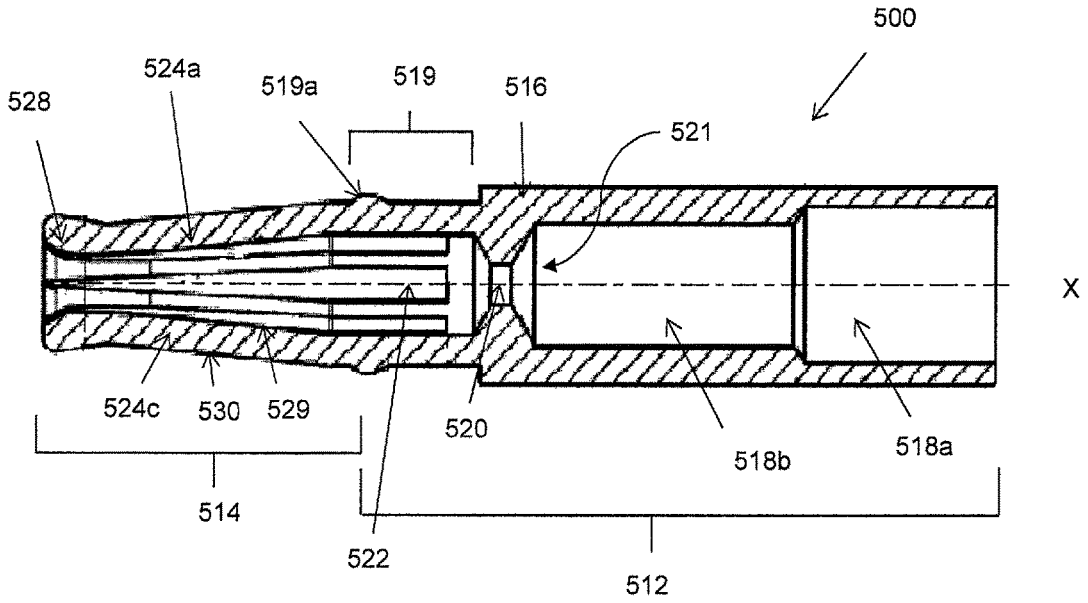
FIG. 7 shows a sectional view of the female contact of FIG. 5 along the longitudinal axis.
Figure 7A:
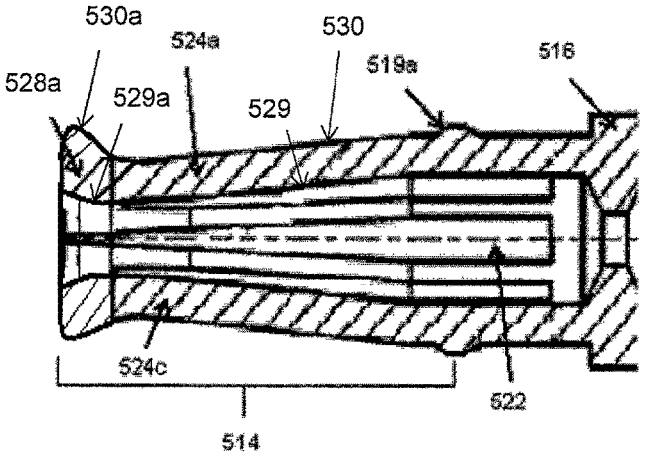
FIG. 7A shows an enlarged view of the contact portion of the female contact shown in FIG. 7.
Figure 8:
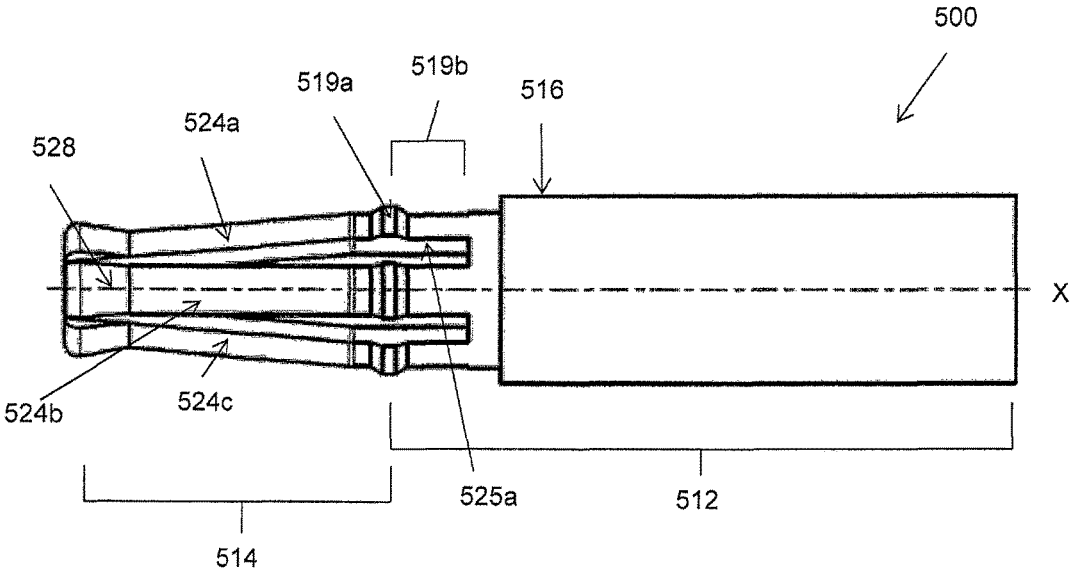
FIG. 8 shows a top view of the female contact of FIG. 5.

The tip portion 528 is located at the end of finger 524*a* that is distal the body portion 512, and in the present embodiment, comprises a curved portion that extends away from the longitudinal axis X of the body portion 512, creating a larger diameter at the end of the tip portion 528, relative to where the tip portion 528 begins on the contact portion 514. This characteristic results in a tip portion 528 with the profile of a hollow frustum of a cone that has been cut into sixths along the length of its longitudinal axis X, the tip portion 528 being located at the end of the contact portion 514, wherein one end of the tip portion having the smaller diameter meets the point where the diameter of the contact portion 514 is at its smallest. Tip portion 528 can act as a lead in or guide for a male pin (not shown) during mating, such that the male pin is more easily and readily inserted into contact portion 514. It will therefore be apparent from the above that the contact portion 514 has fingers 524 that taper inwards towards the central longitudinal axis X and then taper outwards in the tip portion 528. An inner profile or inner surface 529 of the fingers mirrors an outer profile or outer surface 530 of the fingers such that they are substantially parallel. It will be appreciated that in an alternative embodiment, shown in FIG. 7A, a tip inner profile or a tip inner surface 529*a* may continue tapering inwards or substantially inwards toward the longitudinal axis whilst a tip outer profile or tip outer surface 530*a* tapers outwards resulting in an alternative tip portion 528*a*. In other words, at the tip portion 528*a*, the inner surface 529 extends to an inner surface 529*a* of the tip portion and the outer surface 530 extends to an outer surface 530*a*. The inner surface 529*a* tapers at a different rate than the outer surface 530*a*, such that the inner surface 529*a* and the outer surface 530*a* are non-parallel. In either embodiment, only a relatively small part of one end of the contact portion forms the tip portion. As with the first embodiment, in this embodiment the construction can be achieved by manufacturing the fingers 524 from machined rod metal, as opposed to the commonly used sheet metal manufacturing process. Furthermore, the outwardly flared tip portion 528 can be prevented from entering receptacle portions 518*a*, 518*b* of another similar contact and becoming interlocked when, for example, multiple contacts are being processing in high quantity during various manufacturing processes such as gold plating.

In use, a male pin (not shown) is inserted within the cavity defined by fingers 524*a*, 524*b* . . . and is held in position by these fingers.

The problems regarding undesirable locking together of contacts that can prevent correct plating of products and assembly problems as overcome with the contact 100 as mentioned in relation to the first embodiment is also addressed by the contact 500 and tip portion 528 of this embodiment. Further, the increased forces provided by locating springs or '0' rings on the contact 100 are also achieved with the contact 500. The description is not repeated here for brevity but the function and advantages of tip portion 528 would be understood by the skilled person through reference to the first embodiment.

Figure 9:
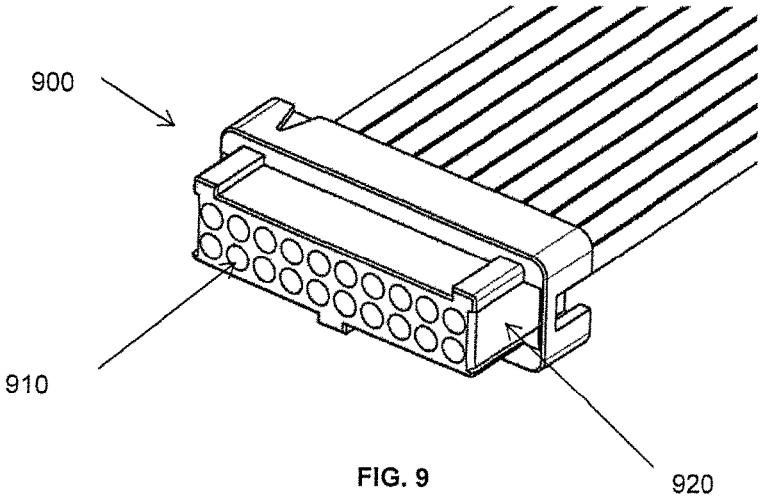
FIG. 9 shows an embodiment of an electrical connector comprising an insulating housing for electrical contacts such as the electrical contacts in FIG. 1 or 5.
Figure 10:
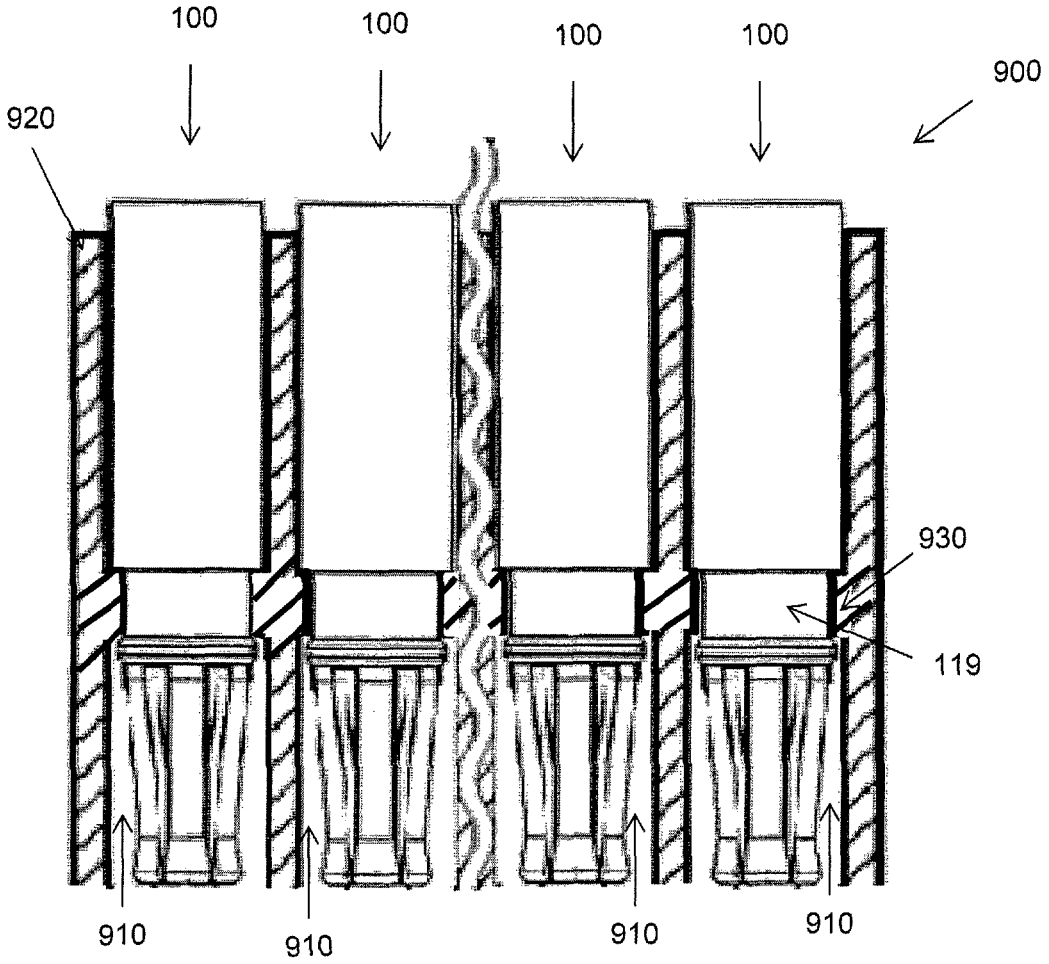
FIG. 10 shows a sectional view of the insulating housing of FIG. 9, comprising a plurality of female contacts of FIG. 1.

FIG. 9 illustrates an electrical connector 900, comprising an insulating housing 920, and a plurality of holes 910 for electrical contacts. FIG. 10 shows the side portions of the insulating housing 920, comprising four female contacts 100 within the holes 910. This is purely exemplary; it should be appreciated that any number of female contacts may be provided within the insulating housing 920 depending on the number of holes in the housing. It will also be appreciated that contacts 500 (of FIG. 5) could be located within the holes 910 instead of contacts 100. In the present embodiment, the electrical connector 900 is generally cuboidal, but other shapes may be used. The hole 910 within the insulating housing 920 may have a protrusion 930 along part of its length to align with complimentary features of the housed contact 100, 500. In this embodiment the protrusion 930 extends around the entire inner circumference of the hole 910 within the insulating housing 920, however this is not a requirement. The protrusion 930 has the effect of reducing the diameter of a portion of the hole 910. When the contact 100, 500 is inserted into the hole 910, the recessed portion 119, 519 fits into this smaller diameter portion of the insulating housing 920. The contact 100, 500 is then held in place via both the wider body portion 112, 512 of the contact 100, 500, and by the protrusion 119*a*, 519*a* of the contact 100, 500. As the diameter of the tip portion 128, 528 increases along the longitudinal length of the contact 100, 500, the distance from the end of the tip portion to the side wall of the insulating housing 920 is reduced. It is this feature that can provide the increased resistance to shock and vibrations as the insulating housing 920 is more able to dampen any shocks on the contact, can prevent high amplitude modes, and prevent potentially over stressing the contact 100, 500. The contact 500 of the second embodiment can provide the additional benefit due to the slots 525*a-f* extending beyond the protrusion 519*a* making recessed portion 519 more compliant (compared to contact 100) during an assembly process into the housing 920 as there is a reduced force required to assemble the contact 500 to the housing 920. The protrusion 519*a* can move radially inward or outwards due to the slots extending beyond it. The protrusion 930 of housing 920 contributes to the compliance of the contact 100 (contact without extended slots) during the assembly process.

Benefits that may be provided by one or more of the embodiments are that: 1) the profile tip 128/528 can provide increased contact force for improved shock and vibration performance; 2) the profile tip 128/528 can prevent compliant section being over stressed (damaged); 3) the profile tip 128/528 can prevent multiple parts in a container becoming locked together by tip 128/528 entering hole 118*b*/518*b;* 4) extended slots 525*a* make retention feature 519*a* compliant when assembled through step 930, thereby reducing assembly forces and chances of damage to 930, and increasing number of times contact can be replaced in housing; 5) the tip portion 128 can also be used to retain various types of springs or '0' rings on the contact. These springs can be used to increase the contact force by variable amounts to improve both contact resistance and shock and vibration performance; 6) 6 fingers instead of 3 or 4 can increase the number of contact points, to improve power, shock and vibration specification of contact.

Numerous modifications, adaptations and variations to the embodiments described herein will become apparent to a person skilled in the art having the benefit of the present disclosure, and such modifications, adaptations and variations that result in additional embodiments of the present invention are also within the scope of the accompanying claims.

In addition to the claimed embodiments in the appended claims, the following is a list of additional embodiments which may serve as the basis for additional claims in this application or subsequent divisional applications:

Embodiment 1

A female electrical contact comprising;

a body portion, and a contact portion that is distal the body portion, comprising a tip portion, wherein the contact portion comprises a plurality of fingers tapered towards the longitudinal axis of the contact, wherein the tip portion at an end of the contact portion that is distal to the body portion, wherein slots are located between adjacent fingers, and wherein at least one of the plurality of fingers of the contact portion bend outwards at the tip portion away from the longitudinal axis of the contact.

Embodiment 2

The contact of embodiment 1, wherein some or all of the plurality of fingers bend outwards at the tip portion away from the longitudinal axis of the contact.

Embodiment 3

The contact of embodiment 1, wherein the tapering is uniform.

Embodiment 4

The contact of any preceding embodiment, further comprising a protrusion located on the outer surface of the contact.

Embodiment 5

The contact of embodiment, wherein the protrusion extends around the entire circumference of the contact.

Embodiment 6

The contact of any preceding embodiment, wherein a first hole is provided in the contact portion.

Embodiment 7

The contact of embodiment 6, wherein at least one second hole is provided in the end of the piece of material that is distal the contact portion.

Embodiment 8

The contact of embodiment 7, wherein the contact includes a through hole, the through hole connecting the first and at least second holes to form a channel through the interior of the contact.

Embodiment 9

The contact of any preceding embodiment, wherein at least a part of the contact is plated.

Embodiment 10

The contact of embodiment 9, wherein the plating includes at least one of gold and nickel.

Embodiment 11

The contact of any one of embodiments 4 or 5, wherein at least one slot extends beyond the protrusion of the contact.

Embodiment 12

The contact of any preceding embodiment, wherein the plurality of fingers comprises at least six fingers.

Embodiment 13

An electrical connector comprising an insulating housing and at least one hole, wherein the electrical contact of any preceding embodiment is located within the at least one hole.

Embodiment 14

The electrical connector of embodiment 12, wherein the electrical connector comprises a plurality of holes and one or more of the holes is provided with the electrical contact.

The invention claimed is:

1. A female electrical contact comprising;

a body portion, the body portion comprising a barrel contoured to form a receptacle; and a contact portion that is distal to the body portion, comprising a tip portion, wherein the contact portion comprises a plurality of fingers having an inner surface and an outer surface tapered towards a longitudinal axis of the contact, wherein the tip portion is at an end of the contact portion that is distal to the body portion, wherein slots are located between adjacent fingers, and wherein at least one of the plurality of fingers of the contact portion bend outwards at the tip portion away from the longitudinal axis of the contact, wherein at the tip portion a tip inner surface of the plurality of fingers taper at a different rate to that of a tip outer surface, such that the tip inner surface and tip outer surface are non-parallel, wherein for at least a portion of the tip portion, the inner surface of the plurality of fingers tapers substantially inwards toward the longitudinal axis whilst the outer surface tapers outwards.

2. The contact of claim 1, wherein all of the plurality of fingers bend outwards at the tip portion away from the longitudinal axis of the contact.

3. The contact of claim 1, wherein the inner surface and outer surface of the plurality of fingers taper towards the longitudinal axis at a uniform rate.

4. The contact of claim 1, further comprising a protrusion located on the outer surface of the contact.

5. The contact of claim 4, wherein the protrusion extends around an entire circumference of the contact.

6. The contact of claim 1, further comprising a recessed portion in an outer surface of the body portion at one end of the body portion proximate the contact portion, and wherein the recessed portion comprises a drilled cavity and the barrel comprises a though hole adjacent the drilled cavity and the receptacle.

7. The contact of claim 1, wherein the contact portion has a cavity and wherein the contact includes a through hole, the through hole connecting the receptacle and the cavity to form a channel through the interior of the contact from the body portion into the contact portion.

8. The contact of claim 1, wherein the contact is formable from machined rod metal.

9. The contact of claim 4, wherein at least one slot extends beyond the protrusion of the contact.

10. The contact of claim 1, wherein the plurality of fingers comprises at least six fingers.

11. An electrical connector comprising an insulating housing and at least one hole, wherein the electrical contact of claim 1 is located within the at least one hole.

12. The electrical connector of claim 11, wherein the electrical connector comprises a plurality of holes and one or more of the holes is provided with the electrical contact.

13. Use of an electrical contact of claim 1 in an electrical connector comprising an insulating housing and at least one hole within which the contact is locatable.

14. The contact of claim 1, further comprising a piece of material having an end that is distal the contact portion, said end having at least one second hole.

* * * * *